United States Patent [19]

De Porcellinis

[11] Patent Number: 4,656,796

[45] Date of Patent: Apr. 14, 1987

[54] BUILDING STRUCTURE AND METHOD OF PRODUCING THE SAME

[75] Inventor: Pietro De Porcellinis, Madrid, Spain

[73] Assignee: Rodio Foundation Engineering Ltd., Zurich, Switzerland

[21] Appl. No.: 787,387

[22] Filed: Oct. 15, 1985

[30] Foreign Application Priority Data

Oct. 19, 1984 [CH] Switzerland ..... 5028/84

[51] Int. Cl.[4] ..... E05D 15/48

[52] U.S. Cl. ..... 52/169.7; 52/743; 166/295; 427/372.2

[58] Field of Search ..... 52/169.7, 743, 741, 52/742, 309.1, 309.3; 405/270; 427/372.2, 384, 388.4, 136; 428/524; 166/293, 295

[56] References Cited

U.S. PATENT DOCUMENTS

| | | | |
|---|---|---|---|
| 2,940,729 | 6/1960 | Rakowitz | 166/295 |
| 4,207,017 | 6/1980 | Jarrell | 405/270 |
| 4,263,759 | 4/1981 | Miller | 52/169.7 |
| 4,366,194 | 12/1982 | Pilny et al. | 405/270 X |
| 4,514,463 | 4/1985 | Alteepping et al. | 405/270 X |

FOREIGN PATENT DOCUMENTS

| | | | |
|---|---|---|---|
| 2436860 | 5/1980 | France | 52/169.7 |
| 2443546 | 8/1980 | France | 52/169.7 |

*Primary Examiner*—Carl D. Friedman
*Assistant Examiner*—Naoko N. Slock
*Attorney, Agent, or Firm*—Antonelli, Terry & Wands

[57] ABSTRACT

A building structure sealed against hydrostatic pressure and a process for constructing a building structure wherein the building structure is fashioned of concrete or stabilized natural substratum. The building structure is in the form of sandwich-like layers which are applied to a base layer with adherence between the respective layers being accomplished by polymerization. At least one layer is applied to the surface of the structure exposed to the hydrostatic pressure and is allowed to at least partially solidify. A web is impregnated with a synthetic sealing and impregnating compound and applied, in an unpolymerized condition, to the first layer so as to allow the web to polymerize in situ.

12 Claims, 7 Drawing Figures

BUILDING STRUCTURE AND METHOD OF PRODUCING THE SAME

The present invention relates to a building structure and, more particularly, to a building structure which is sealed against water pressure and which is fashioned of concrete or stabilized natural substrate as well as a method of constructing the building structure sealed against water pressure.

Sealing surfaces represent one of the most important components of structures in civil engineering especially in water drainage, sealing of retaining dams, linings of canals, linings of ditches or trench linings, as well as other ground water protection and similar projects.

For the purpose of providing a sealing surface, hydraulically bonded impervious types of concrete have been proposed which include Portland cement and sealing materials in the form of fluidizing agents for concrete, plasticising agents or hydrophilising agents.

To reduce the permeability of concrete, it has been proposed to use air entraining agents or foaming agents, which agents reduce cracks and lead to improvement in the concrete by a pore formation during grouting.

In order to improve the sealing surfaces, methods have been proposed which include the supply of concrete using air either as sprayed mortar or pumped concrete as well as de-watering process known as vacuum concrete.

In order to improve layers of loose earth, it has also been proposed to utilize binding agents and employ mechanical compaction to such an extent that layers can be employed as impermeable covering. However, a disadvantage of these proposals resides in the fact that the strength under mechanical loads remains very limited and, in some instances, it is only possible to realize a mere reduction in water seepage.

A significant improvement in the sealing of sealing surfaces has been achieved through the use of bituminous surfacings in hydraulic projects. The proposed methods for bituminous or asphalt concrete were developed from road building techniques which were subsequently appropriately adapted and refined. Large projects have been executed on horizontally extending earth or ground surfaces and inclined banks Generally, variants are used having more than one layer which optionally also include intermediate layers for drainage. Although the results attained with respect to the sealing efficiency were satisfactory, difficulties have been encountered in the course of construction. More particularly, an extremely precise treatment is required for larger surfaces and the control of the surfaces as well as the location of the leaks is troublesome, time consuming, and costly. Moreover, the construction on an inclined bank turns out to be considerably more difficult than the construction on level surfaces. The repair of leaking joints or other damaged spots has especially proved itself to be a considerable problem. In this connection, as a rule, the damaged spots or portions have to be completely replaced and, for this purpose, it is necessary to decommission or shut down the installation involved.

A further disadvantage of the last mentioned proposals resides in the fact that the resulting structure has a low mechanical strength, is susceptible to rapid aging affects, and is susceptible to chemical attacks. Moreover, Bituminous coverings are, by their nature, unstable if they come in contact with mineral oil.

A recent innovation in hydraulic engineering has been an introduction of membranes of synthetic material; however, the available choice of new synthetic material such as PVC (polyvinylchloride), PE (polyethylene), Nylon, Hypalon, etc, is extremely large and the processing directions for the synthetic materials vary a great deal; therefore, the choice of material becomes increasingly more difficult for a perspective user. In spite of intensive research and issuance of meticulous documentation with classifications or standards, a gap between the properties of the materials indicated by the manufacturers of the pre-fabricated membranes and the average production results which may be achieved on large construction sites by experienced operatives is relatively large. As has become apparent from a review of publications relating to technical meetings, it can be observed that climatic conditions, site conditons, human failure, or accidental circumstances play such a large role that material values which have been measured in a laboratory and workshop cannot be achieved by a wide margin building site. The higher the chemical stability of the raw product produced in the factory, the more difficult it becomes to process the product to a continuous sealing layer or lining on a construction site.

The aim underlying the present invention essentially resides in providing a building structure sealed against water pressure and the method for constructing the building structure which enables the building structure to not only be constructed simply, safely, and economically on site but also constructionally improves the structure by ensuring a better sealing of the building structure against water while minimizing if not avoiding the problem of the occurrence of cracks in the building structure.

In accordance with advantageous features of the present invention, a building structure sealed against water pressure is provided which includes a substance of concrete or stabilized natural substratum, with the building structure being fashioned of sandwich-like layers clasped or affixed to one another whereby the clasping is accomplished between at least two layers by a polymerization.

Advantageously, in accordance with the present invention, the building structure includes at least a first intermediate cover layer of an essentially homogenous mass of concrete on a side exposed to the hydraulic pressure, with the intermediate layer being covered by a sealing layer, polymerized in situ and containing a synthetic sealing and impregnating compound. Preferably, a web lies on the intermediate layer to form a sandwich-like cladding type or plating lining.

The sealing and impregnating compound utilized in accordance with the present invention may consist essentially of at least one of a Neoprene-latex or a Chloroprene.

It is also possible in accordance with the present invention for the sealing and impregnating compound to consist essentially of at least one of a Neoprene-latex containing mass.

Advantageously, in accordance with the present invention, the building structure of the present invention may include a cover layer which is fashioned of a plurality of overlapping layers and, for example, the intermediate layer may be fashioned of single sections which either randomly or at a predetermined position are separated from one another by a shrink-free joint of, for example, mortar or the like.

In accordance with the process of the present invention, a building structure sealed against water pressure is provided by forming an outline of the structure and allowing the outline of the structure to stablize. At least a compound consisting essentially of concrete is applied as a first layer to a surface of the structure exposed to water pressure and the first layer is allowed to at least partially solidify. Finally, with the first layer in an at least partially settled state, a web is impregnated with a sealing and impregnating compound and the web is applied in an unpolymerized condition to the first layer so as to allow the web to polymerize in situ.

Advantageously, in accordance with the method of the present invention, the sealing and impregnating compound is a monomer of, for example, a water-soluble acrylamide and, advantageously, the monomer is a water-soluble acrylamide.

In accordance with still further features of the method of the present invention, the first layer is applied in a continuous manner and the web is used as a cover layer and is impregnated while the web is being applied to the first layer. The web may be impregnated by a mass essentially consisting of at least one of Neoprene-latex or Chloroprene.

Accordingly, it is an object of the present invention to provide a building structure and method for constructing the structure which avoids, by simple means, shortcomings and disadvantages encountered in the prior art.

Another object of the present invention resides in providing a building structure and method for constructing the structure which improves the sealing surfaces in hydraulic structures so as to minimize if not avoid the occurrence of water seepage and accompanying damages.

A further object of the present invention resides in providing a building structure and method for constructing the structure which is simple and therefore relatively inexpensive to carry out.

These and other objects, features, and advantages of the present invention will become more apparent from the following description when taken in connection with the accompanying drawings which show, for the purpose of illustration only, several embodiments in accordance with the present invention.

Figure 1:
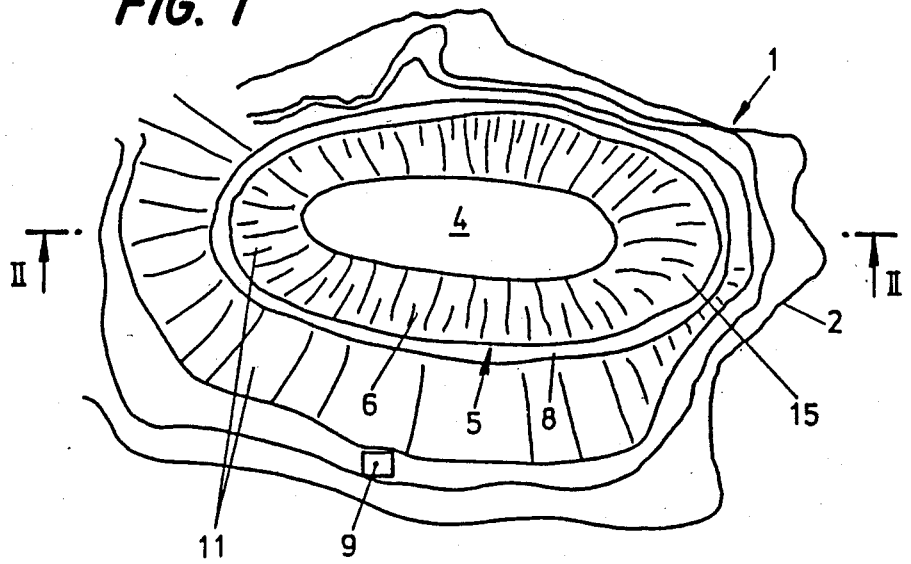
FIG. 1 is a portion of a contour or cartographic view of a storage reservoir representing a constructional building structure sealed against water pressure.
Figure 2:
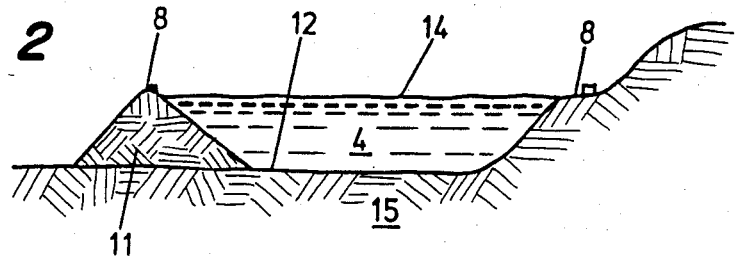
FIG. 2 is a cross-sectional view of the storage reservoir of FIG. 1 taken along the line II—II in FIG. 1.

Referring now to the drawings wherein like reference numerals are used throughout the various views to designate like parts and, more particularly, to FIGS. 1 and 2, according to these figures, a landscape generally designated by the reference numeral 1 includes contour lines 2, with the landscape 1 including a control station 9, a storage reservoir 4, and a retaining dam generally designated by the reference numeral 5 having a side wall 6 forming a closed loop, defining the storage reservoir 4, and with the retaining dam 5 having a dam crown 8.

The landscape 1 further includes an artifically built-up dam portion 11 which compliments the natural par of the landscape formed by a ground area 15 to form the storage reservoir 4. As shown in FIG. 2, the storage reservoir 4 includes a reservoir floor 12, with the storage reservoir 4 accommodating water having an upper water level 14.

With structures such as the storage reservoir 4, it is an extremely important requirement that the reservoir be constructued with side walls 6 which are as impermeable as possible so as to prevent water loss and, in particular, the gradual errosion of the artifical dam part 11 caused by the water loss. For this purpose, the side wall 6 of the storage reservoir 4 facing the water as well as possible further portions of the reservoir 4 must be subjected to a special treatment or be constructed with appropriate materials and through an appropriate process.

Figure 3:
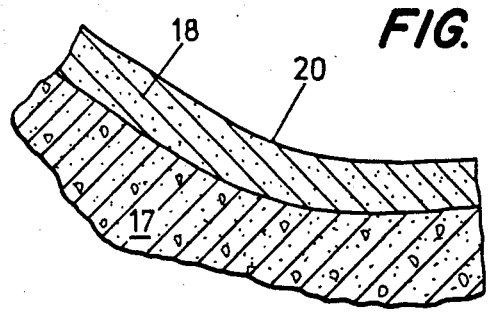
FIG. 3 is a partial cross-sectional view, on an enlarged scale, of a portion of the building structure of FIG. 1, in a somewhat schematic representation.

The fundamental construction of the side wall 6, as shown in FIG. 3, includes at least one concrete substructure layer 17, a specifically formed waterproof intermediate layer 18, and a waterproof top layer 20, with the layers 17, 18, 20 being bound or clad to one another in a manner described more fully hereinbelow to form a sandwich-like construction.

Figure 4:
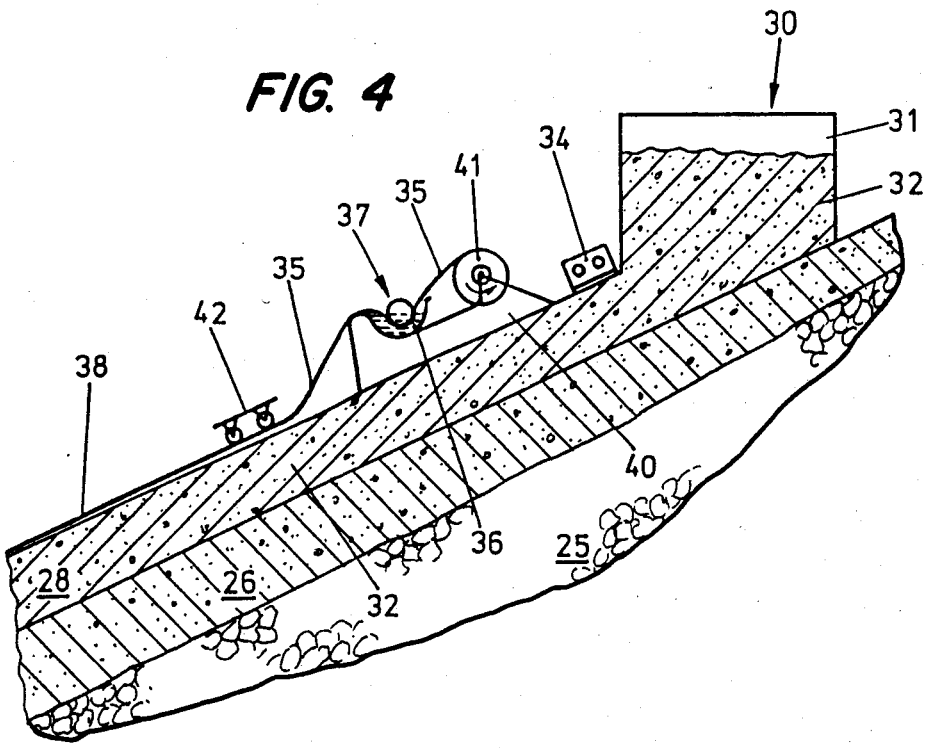
FIG. 4 is a partial schematic cross-sectional view of an integrated remotely controlled preparation plant for producing a structure sealed against water pressure.

As shown in the schematic representation of FIG. 4 of a side wall of the retaining dam 5 in a direction of a dip during the course of construction, a rubble or rock filled dam 25 forms the base, the contours of which have been smoothed out by a layer 26 forming a substratum for an intermediate cover layer 28, of an essentially homogenous mass of concrete on a side exposed to the hydraulic pressure, which is being fashioned or constructed by a shuttering carriage generally designated by the reference numeral 30. The shuttering carriage 30 includes a hopper 31 to which fresh concrete is supplied and a vibration boom 34 serves to compact the layer 28 after the concrete mass 32 is discharged from the hopper 31 of the shutter carriage 30. A web or non-woven fabric reinforcement membrane 35, provided with an impregnating and sealing compound 36, is next applied to the fresh concrete 32 which may or may not be set, with the strips of the web reinforcement membrane 35 being pulled through a trough generally designated by the reference numeral 37 so as to coat the surfaces 38 with the impregnating and sealing compound 36. A pull-off frame 40 includes a supply roller 41 which carries the web reinforcement membranes prior to the impregnating or coating with the impregnating and sealing compound 36. After the reinforcement membranes 35 have been coated, pressure rollers 42 press the membranes 35 onto the fresh concrete layer 32.

The layer 26 of, for example, concrete earth or similar material, is applied to the rock or rubble fill dam 25 which serves to form a base for further assembly of the reinforcement membrane 35 by flattening out any unevenness of the rock or rubble fill dam 25 thereby producing a free upper surface which can readily accept or accommodate the specific coverings or layers to be applied and enable the coverings or layers to be bound thereto. For this reason, the application of a specific compensation layer in the form of an intermediate cover layer 28 follows after the layer 26, which is made of concrete, earth, or the like which layer has set.

While FIG. 4 illustrates the provision of a layer 26 between the rock or rubble fill dam 25, it is also possible to apply the intermediate layer 28 directly on the rubble or rock filled dam 25. The web reinforcement membranes 35 are coated or impregnated in the trough 37 and subsequently applied on the free upper surface of the intermediate cover layer 28. The sealing and impregnating compound may, for example, consist essentially of a Chloroprene and/or Dupont-Neoprene-latex employed as a finished product under the name of "Hydrogel". This product is a water soluble formulation of acrylamide or similar water-soluble monomeres with different additives which, due to their special compatibility with Portland cement improve the properties of concrete. The outer finishing layer is applied in the form of a surface covering 38 in a non-polymerized condition onto the intermediate cover layer 28 which may or may not have been completely hardened or set. After the impregnating compound of the web reinforcement membrane 35 has finished polymerizing, an adhesive connection results between both layers 28 and 38 which is at least similar to a connection or bonding which results in the plating of metal sheets.

By virtue of the procedure or process described hereinabove in connection with FIG. 4, a building structure is created with a plurality of layers 26, 28 and 38 which have a sandwich-like formation but are coupled together with and between each other in the manner of a cladding or plating. This constructional composition or building structure has substantially better characteristics than could be obtained from the raw materials used in the manufacture thereof or compared with conventional construction methods in which the upper finish was provided by ready-made final layers in the form of sheets which are no longer subjected to change.

As a result of the simultaneous preparation of the carrying or supporting layer and the protective layer, if not completely hardened, the hydration process of the Portland cement in the layer 28 is controlled in a novel manner and the drying out phase is omitted so as to minimize the crack formation. A special feature of the above-described process or procedure of the present invention resides in the fact that it is possible to obtain a synthetic impervious layer which can be applied over large and very steep surfaces because of the setting together of the supporting and impervious layer. Moreover, no permanent stresses are induced on the synthetic layer by virtue of its own weight.

The important or crucial material and its treatment, that is to say, the Hydrogel mass preferably reinforced with synthetic fibers, produces a waterproof or leakproof surface structure due to the procedure or process outlined above by reason of the not completely hardened or not completely set intermediate layer 28 whereby all the remaining hollow cavities or cracks of the concrete substratum are sealed off. The waterproof structure so obtained, forming the side wall 6, resists in a considerably better manner, the mechanical loads and serves, at the same time, to seal off the structure.

Applying the latest insights in high polyme chemistry reaction products of water soluble monomers such as, for example, acrylamide with elastomers, bitumen emulsions and fillers are thereby selected which excell particularly in their stability and compatibility with hydraulic binder materials. The products prepared on this basis are all characterized by the influence established on constructional materials such as for example, concrete, cement, or the like so as to result in a significant improvement in the resulting building structure.

Figure 5:
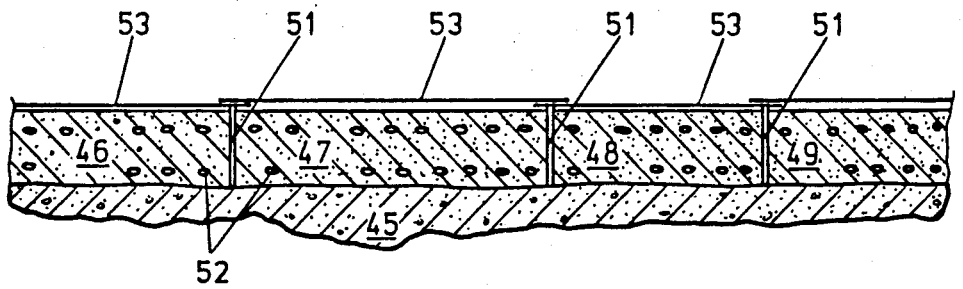
FIG. 5 is a partially schematic view illustrating a preparation of an intermediate lining in a step-by-step process.

FIG. 5 provides an example of an application of the present invention wherein the structure to be sealed against water pressure is prepared in a step-by-step process, that is, in stages. More particularly, as shown in FIG. 5, a concrete structure 45 forms a subsurface onto which sections or slabs of intermediate layers 46, 47, 48 and 49 have been applied in stages. Shuttering or abutment rails 51 are drawn between the sections and metal reinforcement members 52 are provided in the respective intermediate layers 46–49, with cover layers 53, in the form of membranes, serving as the upper finish of the structure. The assembly of the individual layers is effected in the same way as in the embodiment of FIG. 4. The sections are normally constructed having a width of from 4.5 to 5 m whereby the membranes of the cover layer 53 overlap and seal the abutments 51.

Figure 6:
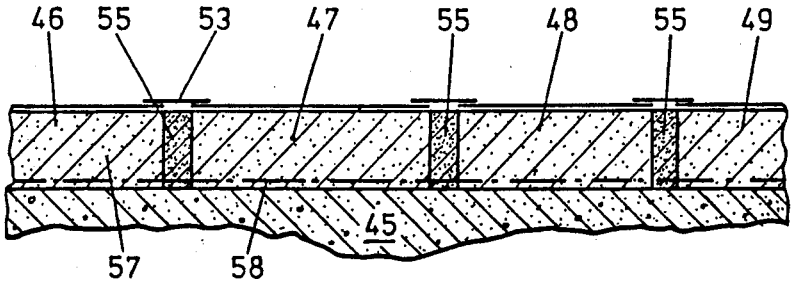
FIG. 6 is a partially schematic cross-sectional view of an intermediate lining prepared in a continuous process.

FIG. 6 provides an example of an assembly of a structure analogous to FIG. 5 but prepared in a continuous process. As with FIG. 5, the concrete building structure 45 has sections of cover layers 46–49 applied thereto. Layers of, for example, shrink-free jointing motar 55 are interposed between the cover layers 46–49. A layer of a vapor barrier 58 may be disposed in the reinforced impregnation zone 57. A width of the layers of the jointing motar 55 may readily be adapted widthwise in accordance with the prevailing circumstances or may be of a varying width. The corresponding layers 46–49 are formed of the compositions described hereinabove in connection with FIG. 4 and are applied in the manner described hereinabove in the appropriate setting conditions.

Figure 7:
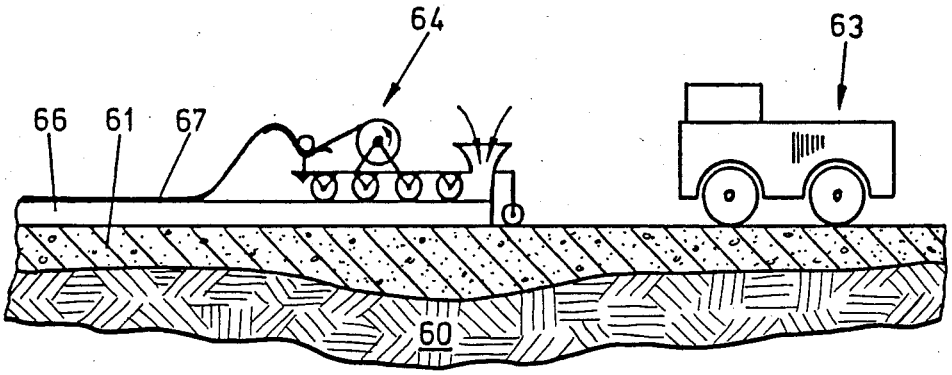
FIG. 7 is a partially schematic cross-sectional view illustrating a construction of an intermediate lining on a horizontal carrier in a manner similar to the structure illustrated in FIG. 4.

FIG. 7 provides a schematic representation of the preparation of a lining on a horizontal support and, as shown in this Figure, a concrete leveling layer 61 is applied on natural soil 60. After the leveling layer has hardened, it is possible to then start the application of the special layers. A construction vehicle generally designated by the reference numeral 63 assists in preparing the leveling layer 61, with a preparation plant generally designated by the reference numeral 64, adjacent to the construction vehicle 63 serving to form an intermediate layer 66 as well as a cover layer 67 in a similar manner as shown and described in connection with FIG. 4. The intermediate layer 66 and cover layer 67 are prepared from appropriate materials and in accordance with the method or process described hereinabove in connection with FIG. 4.

By virtue of the utilization of the newly developed process in accordance with the present invention, a novel mixed material is prepared from synthetic products which is used as a surface coating set at the site conditions taking into account, for example, the temperature of the site conditions. It has been demonstrated that this has the necessary properties to meet all practical requirements for the sealing of concrete and the briding of cracks as well as for application on relatively large surfaces.

By virtue of the simultaneous manufacturing process of the intermediate and cover layer, the hydration of the Portland cement is controlled in a novel manner and the dry out phase is omitted so that shrinking is reduced and crack formation is reduced to a micro-level. The layered construction ensures the new material with a leakproof surface structure from the Hydrogel compound reinforced with synthetic fibers so that all remaining cavities or cracks of the concrete subsurface are sealed.

The so produced waterproof surface lining can be dimensioned in such a manner that it withstands the mechanical stresses and, at the same time, fulfills its purpose of sealing the structure. The building material may readily be produced in an especially developed movable mixing and preparation installation and industrial mass production may be achieved by preprogramming and remote control so as to exclude human error to a considerable degree as well as guaranteeing an accurate preparation and a construction of a mechanically strong waterproof surface lining.

By virtue of the present invention, it is possible to prepare support or sealing linings in a single working-pass as well as the preparation of a continuous support or sealing lining on a site when and where needed. Moreover, it is possible to achieve a sealing without joints capable of accepting stress as well as the possibility of bridging existing cracks. The features of the present invention enables the repairing of a sealing under water as well as the preparation of the support and sealing liners in accordance with building site constructions so that such preparation may be carried out in a stage by stage or continuous process. Furthermore, by virtue of the building structure and process of the present invention, a preparation of the support and sealing lining may be readily carried out on a level or inclined substratum through the use of a special apparatus for processing the raw materials for preparation of the support and sealing linings. Additionally, the method proposed by the present invention enables the assembly of raw materials for the preparation of the support and sealing linings as a continuous seal against water, and the compounding of the raw materials for a particular sealing purpose such as, for example, against the action of mineral oil, hazardous chemicals, etc.

While I have shown and described several embodiments in accordance with the present invention, it is understood that the same is not limited thereto but is susceptible of numerous changes and modifications as known to one having ordinary skill in the art, and I therefore do no wish to be limited to the details shown and described herein, but intend to cover all such modifications as are encompassed by the scope of the appended claims.

I claim:

1. A building structure sealed against hydrostatic pressure and comprising one of a concrete and stabilized natural substratum, the building structure comprising at least a first cover layer of an essentially homogeneous mass of concrete on a side exposed to the hydrostatic pressure, an intermediate layer covered by a sealing layer polymerized in situ, the sealing layer containing a synthetic sealing and impregnating compound and being fashioned as a web disposed on the intermediate layer so as to form a sandwich-like plating lining.

2. A building structure according to claim 1, wherein the sealing and impregnating compound consists essentially of at least one of Neoprene-Latex and Chloroprene.

3. A building structure according to claim 1, wherein the sealing and impregnating compound consists essentially of at least one of a Neoprene-Latex containing a mass material.

4. A building structure according to claim 1, wherein the sealing layer is formed of a plurality of individual members of a predetermined width disposed on the intermediate layer, with adjacent edges of the respective layers being disposed in an overlapping relationship.

5. A building structure according to claim 1, wherein the intermediate layer includes a plurality of individual sections, and wherein at least one shrink-free joint means is provided for separating the individual sections from one another.

6. A building structure according to claim 5, wherein the shrink-free joint means is formed as a jointing mortar.

7. A method for constructing a structure sealed against hydrostatic pressure, the method comprising the steps of forming an outline of the structure, allowing the outline of the structure to stabilize, applying at least a first layer to a surface of the structure exposed to the hydrostatic pressure, allowing the first layer to at least partially solidify, impregnating a web with a synthetic sealing and impregnating compound, and applying the web in an unpolymerized condition to the first layer so as to allow the web to polymerize in situ.

8. A method according to claim 7, wherein the sealing and impregnating compound is a monomer.

9. A method according to claim 8, wherein the monomer is a water soluble acrylamide.

10. A method according to claim 7, wherein the first layer is applied as a continuous strip.

11. A method according to claim 7, wherein the web is impregnated while being applied to said first layer.

12. A method according to claim 7, wherein the web is impregnated by a mass essentially consisting of at least one of Neoprene-Latex and Chloroprene.

* * * * *